US008500492B2

(12) United States Patent
Brown et al.

(10) Patent No.: US 8,500,492 B2
(45) Date of Patent: Aug. 6, 2013

(54) RECONFIGURABLE PLUG ADAPTER

(75) Inventors: Gareth Brown, Jersey City, NJ (US); Jordan Diatlo, New York, NY (US)

(73) Assignee: Quirky Incorporated, New York, NY (US)

( * ) Notice: Subject to any disclaimer, the term of this patent is extended or adjusted under 35 U.S.C. 154(b) by 95 days.

(21) Appl. No.: 13/277,764

(22) Filed: Oct. 20, 2011

(65) Prior Publication Data

US 2013/0102174 A1 Apr. 25, 2013

(51) Int. Cl.
*H01R 25/00* (2006.01)

(52) U.S. Cl.
USPC ..... 439/638

(58) Field of Classification Search
USPC ..... 439/638–640, 13, 23, 25, 535–538, 439/19, 131, 171
See application file for complete search history.

(56) References Cited

U.S. PATENT DOCUMENTS

| | | | | |
|---|---|---|---|---|
| 2,134,355 | A | 7/1934 | Caldwell | |
| 3,437,976 | A | 4/1969 | Nelson | |
| 3,771,106 | A | 11/1973 | Matsumoto et al. | |
| 3,951,487 | A | 4/1976 | Waldbrook | |
| 4,583,798 | A | 4/1986 | Blazowich | |
| 5,292,257 | A | 3/1994 | Milan | |
| 5,484,299 | A | 1/1996 | Schlessinger | |
| D381,315 | S | 7/1997 | Harold | |
| D401,220 | S | 11/1998 | Dwight et al. | |
| 5,902,140 | A | 5/1999 | Cheung et al. | |
| D416,860 | S | 11/1999 | Seiwert et al. | |
| 6,068,490 | A * | 5/2000 | Salzberg | 439/25 |
| 6,196,851 | B1 | 3/2001 | Gerard et al. | |
| D445,403 | S | 7/2001 | Veino et al. | |
| 6,786,743 | B2 * | 9/2004 | Huang | 439/131 |
| 6,793,499 | B1 | 9/2004 | Chen | |
| 6,862,403 | B2 | 3/2005 | Pedrotti et al. | |
| D507,237 | S | 7/2005 | Gregory | |
| D514,067 | S | 1/2006 | Lee | |
| 7,125,256 | B2 | 10/2006 | Gerard | |
| 7,247,028 | B2 | 7/2007 | Schriefer | |
| 7,264,514 | B2 | 9/2007 | Hsu et al. | |
| D556,689 | S | 12/2007 | Lee et al. | |

(Continued)

FOREIGN PATENT DOCUMENTS

| | | |
|---|---|---|
| DE | 20313536 | 12/2003 |
| DE | 102005046465 | 4/2007 |
| EP | 0702433 | 3/1996 |

OTHER PUBLICATIONS

International Search Report for International Application No. PCT/US2011/051522, mailed Feb. 28, 2012.

*Primary Examiner* — Renee S Luebke
*Assistant Examiner* — Harshad Patel
(74) *Attorney, Agent, or Firm* — Cooley LLP

(57) ABSTRACT

In some embodiments, an apparatus provides an electrical signal path between an electrically conductive portion of a device plug and a signal port. The apparatus includes a first housing segment having a longitudinal axis. The first housing segment includes a first receptacle configured to receive at least the electrically conductive portion of the device plug and a signal port coupler configured to selectively conductively engage with the signal port. The apparatus includes a second housing segment having a second receptacle configured to receive at least the electrically conductive portion of the device plug. The second housing segment is coupled to the first housing segment for movement relative to the first housing segment about the longitudinal axis of the first housing segment.

24 Claims, 18 Drawing Sheets

U.S. PATENT DOCUMENTS

| | | | | |
|---|---|---|---|---|
| 7,311,533 | B1 * | 12/2007 | Lin et al. | 439/131 |
| 7,435,091 | B1 | 10/2008 | Cruz | |
| 7,488,204 | B2 | 2/2009 | Hsu | |
| 7,500,854 | B2 | 3/2009 | Gottstein | |
| 7,510,420 | B2 * | 3/2009 | Mori | 439/446 |
| D597,948 | S | 8/2009 | Bizzell | |
| 7,771,239 | B1 | 8/2010 | Hsiao | |
| 7,811,136 | B1 | 10/2010 | Hsieh et al. | |
| 7,824,185 | B2 | 11/2010 | Chien | |
| 7,874,856 | B1 | 1/2011 | Schriefer et al. | |
| D633,045 | S | 2/2011 | Cullen et al. | |
| D640,199 | S | 6/2011 | Wilson | |
| 8,011,930 | B2 | 9/2011 | Lee et al. | |
| D651,174 | S | 12/2011 | Le Clair | |
| 8,118,616 | B1 | 2/2012 | Clark | |
| 8,157,574 | B2 | 4/2012 | Hsiao | |
| 2005/0032396 | A1 | 2/2005 | Huang | |
| 2006/0068608 | A1 | 3/2006 | McFadden | |
| 2006/0234561 | A1 | 10/2006 | Tanaka | |

* cited by examiner

RECONFIGURABLE PLUG ADAPTER

FIELD OF THE INVENTION

Some embodiments described herein relate generally to plug adapters, specifically to reconfigurable plug adapters.

BACKGROUND

Permanent electrical and other outlets typically include a limited number of outlets usable to plug in devices requiring electrical power, or requiring access to a signal path to and/or from a signal source. When more outlets are needed, a plug adapter can be coupled to a permanent outlet, which increases the number of outlets available. However, the outlets on such plug adapters may be oriented so that devices such as power adapters having large housings in fixed orientation with respect to their electrical plugs can obstruct some of the outlets, reducing the benefit of the plug adapter. Furthermore, the length and/or width of the plug adapter can limit the locations where the plug adapter can be placed.

Thus a need exists for a reconfigurable plug adapter.

SUMMARY OF THE INVENTION

In some embodiments, an apparatus provides an electrical signal path between an electrically conductive portion of a device plug and a signal port. The apparatus includes a first housing segment having a longitudinal axis. The first housing segment includes a first receptacle configured to receive at least the electrically conductive portion of the device plug and a signal port coupler configured to selectively conductively engage with the signal port. The apparatus includes a second housing segment having a second receptacle configured to receive at least the electrically conductive portion of the device plug. The second housing segment is coupled to the first housing segment for movement relative to the first housing segment about the longitudinal axis of the first housing segment.

DETAILED DESCRIPTION

As used in this specification, the singular forms "a," "an" and "the" include plural referents unless the context clearly dictates otherwise. Thus, for example, the term "rotation boss" is intended to mean a single rotation boss or a combination of rotation bosses.

Figure 1:
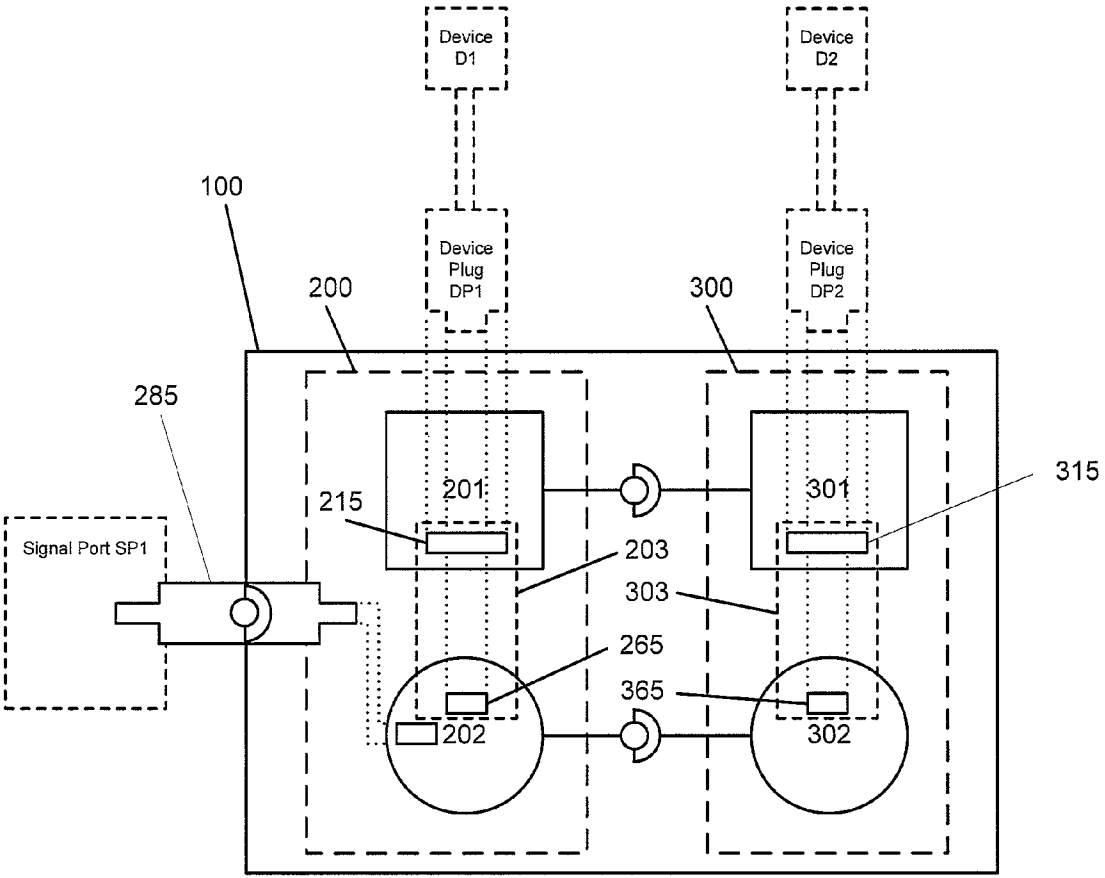
FIG. 1 is a block diagram of a plug adapter according to an embodiment.

FIG. 1 depicts a system block diagram of a plug adapter 100. Plug adapter 100 can be a reconfigurable plug adapter, i.e., can be one or more segments movably connected to one or more other segments. Specifically, plug adapter 100 includes a base segment 200, and an outer segment 300. In some embodiments, plug adapter 100 can include any number of outer segments. Base segment 200 includes a mechanical portion 201, an electrical portion 202 and an outlet assembly 203, and outer segment 300 includes a mechanical portion 301, an electrical portion 302, and an outlet assembly 303.

Mechanical portion 201 of base segment 200 can be configured to movably connect base segment 200 with outer segment 300, and/or a second outer segment (not shown in FIG. 1), to fixedly or selectively physically connect plug adapter 100 to a plug 285, and to guide a device plug DP1 of a device D1 into outlet assembly 203 of base segment 200. Mechanical portion 201 can be configured to mechanically connect device plug DP1 to base segment 200 via mechanical portion 215 of outlet assembly 203. Plug 285 can be configured to connect plug adapter 100 to a signal port SP1. In some embodiments, base segment 200 and outer segment 300 can be movable relative to each other about a single axis in a single plane, for example, outer segment 300 can be rotatable about a single axis, such as, for example, a longitudinal axis, of base segment 200. In other embodiments, base segment 200 and outer segment 300, can be movable relative to each other in one or more other planes and/or about or along one or more other axes.

Electrical portion 202 of base segment 200 can be configured to define a signal path between base segment 200 and the signal port SP1 (via plug 285), and to define a signal path between outer segment 300 and signal port SP1. Specifically, electrical portion 202 can be configured to define the signal path between an electrical portion 265 of outlet assembly 203 of base segment 200 and/or an electrical portion 365 of an outlet assembly 303 of outer segment 300 with the signal port SP1. The signal path can include any signal path and/or combination of signal paths usable to conduct power, data, audio, video, and/or other electrical signals from the signal port SP1 to the base segment 200 and/or the outer segment 300. Electrical portion 202 can be configured to maintain the signal path between the signal port SP1 and base segment 200 and/or outer segment 300 when base segment 200 and outer segment 300 are moved relative to one another. Electrical portion 202 can be configured to fixedly or selectively connect a signal path between plug adapter 100 to a plug 285 via a circuit board (not shown) of base segment 200, and plug 285 can be configured to connect a signal path between plug adapter 100 and the signal port SP1.

Mechanical portion 301 of outer segment 300 can be configured to movably connect outer segment 300 with base segment 200. In this manner, an outer portion can be movably connected to base segment 200. In some embodiments, outer segment 300 can be movable relative to base segment 200, and/or the second outer segment, in a single plane or multiple planes, as discussed above with regard to base segment 200. Mechanical portion 301 can be configured to direct or guide a device plug DP2 of a device D2 into an outlet assembly 303 of outer segment 300. Mechanical portion 301 can be configured to mechanically connect device plug DP2 to outer segment 300 via mechanical portion 315 of outlet assembly 303.

Electrical portion 302 of outer segment 300 can be configured to define a signal path between outer segment 300 and signal port SP1, and to define a signal path between other outer segments and signal port SP1. Specifically, electrical portion 302 can be configured to define the signal path between an electrical portion 365 of outlet assembly 303 of outer segment 300 with signal port SP1. The signal path can include any signal path and/or combination of signal paths usable to conduct power, data, audio, video, and/or other signals to/from signal port SP1 to the outer segment 300 and/or the other outer segments. Electrical portion 302 can be configured to maintain the signal path between signal port SP1 and outer segment 300 and/or the other outer segments when base segment 200, outer segment 300, and the other outer segments are moved relative to one another.

Figure 2A:
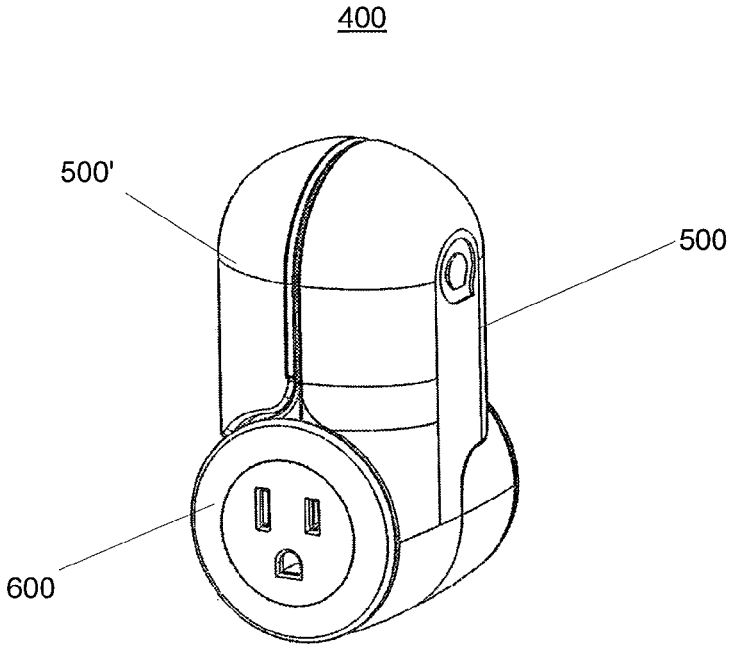
FIG. 2A is a front perspective view of a plug adapter in a first configuration according to an embodiment.
Figure 2B:
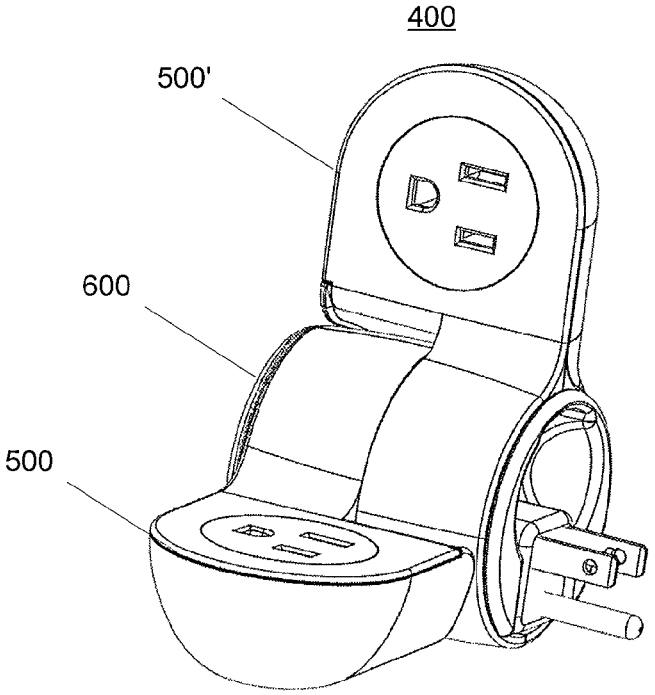
FIG. 2B is a rear perspective view of the plug adapter shown in FIG. 2A in a second configuration.
Figure 2C:
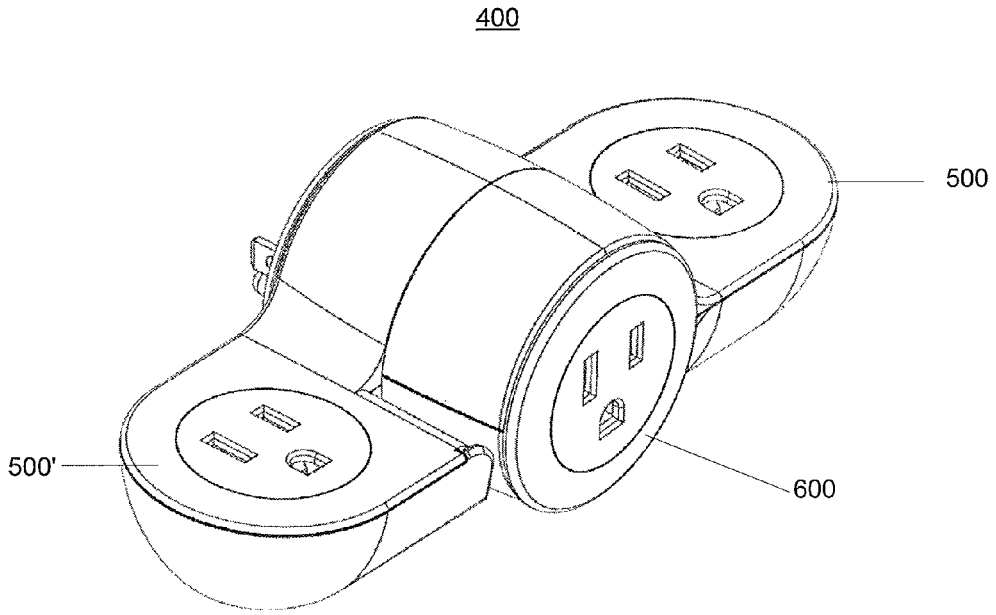
FIG. 2C is a front perspective view of the plug adapter shown in FIG. 2A in a third configuration.

An exemplary implementation of a plug adapter is described in detail below. This implementation is an electrical power adapter, specifically, a 120 volt, 3 prong plug adapter. FIGS. 2A-2C depict a plug adapter 400. Specifically, FIG. 2A is a front perspective view of plug adapter 400 in a first configuration (closed), FIG. 2B is a rear perspective view of plug adapter 400 in a second configuration (partially open), FIG. 2C is a front perspective view of plug adapter 400 in a third configuration (fully open). Plug adapter 400 includes a base segment 600 an outer segment 500 and an outer segment 500'.

Figure 3A:
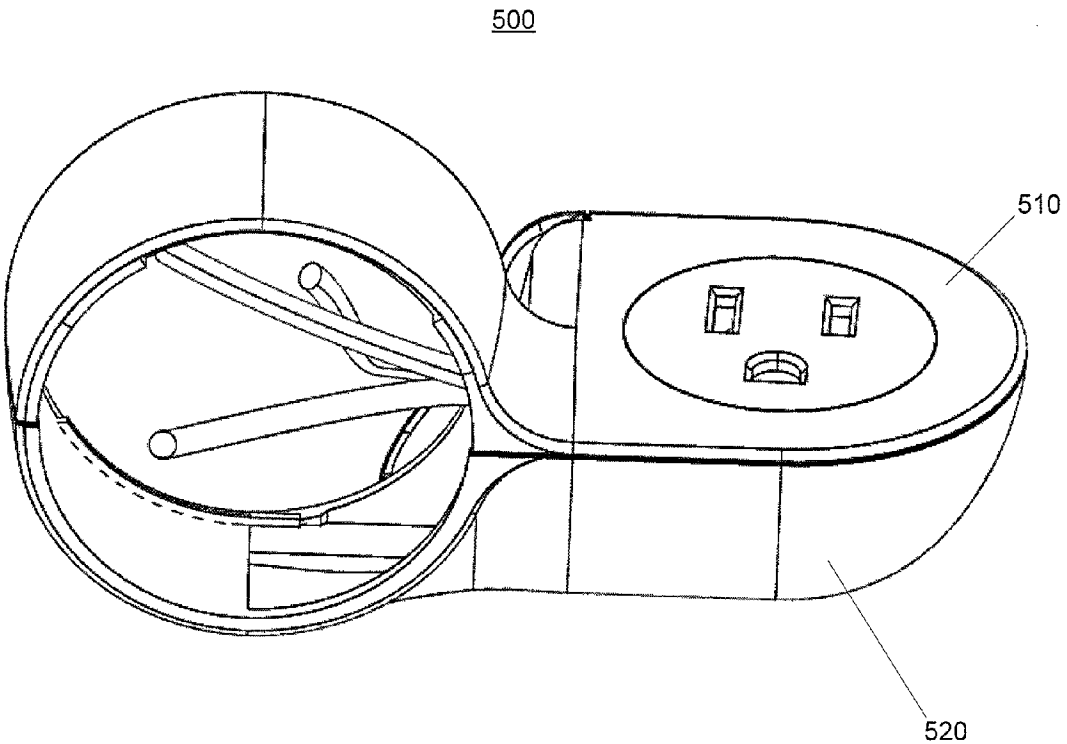
FIG. 3A is a perspective view of an outer segment of the plug adapter shown in FIG. 2A.
Figure 3B:
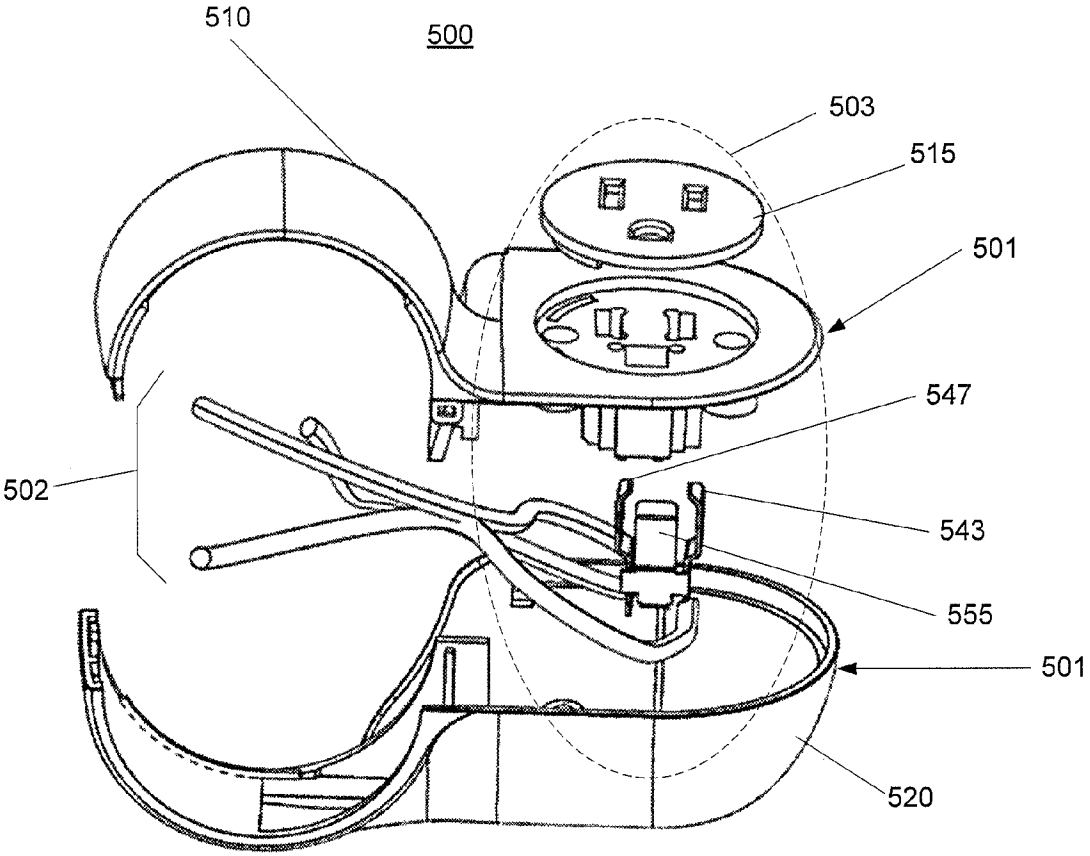
FIG. 3B is partially exploded view of the outer segment shown in FIG. 3A.
Figure 3C:
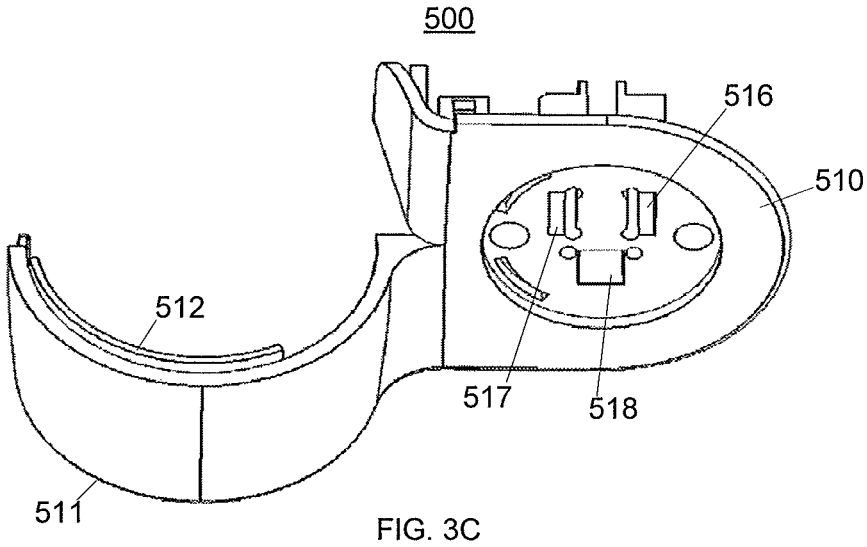
FIG. 3C is a top perspective view of a top housing of the outer segment shown in FIG. 3A.
Figure 3D:
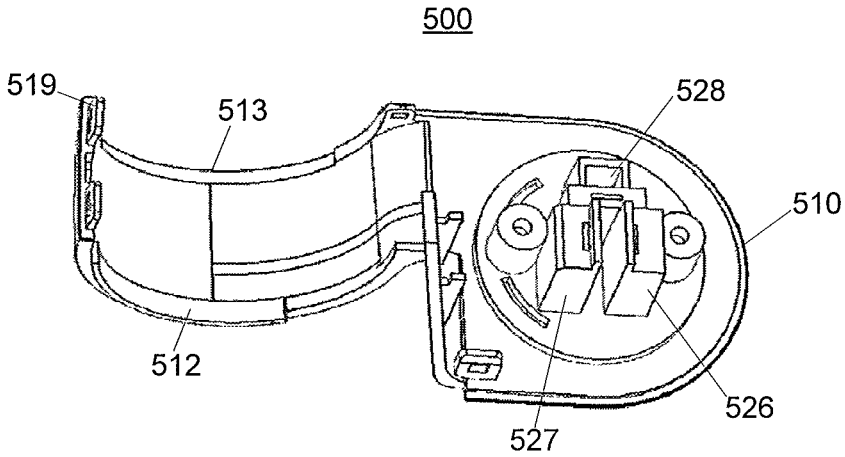
FIG. 3D is a bottom perspective view of the top housing shown in FIG. 3C.
Figure 3E:
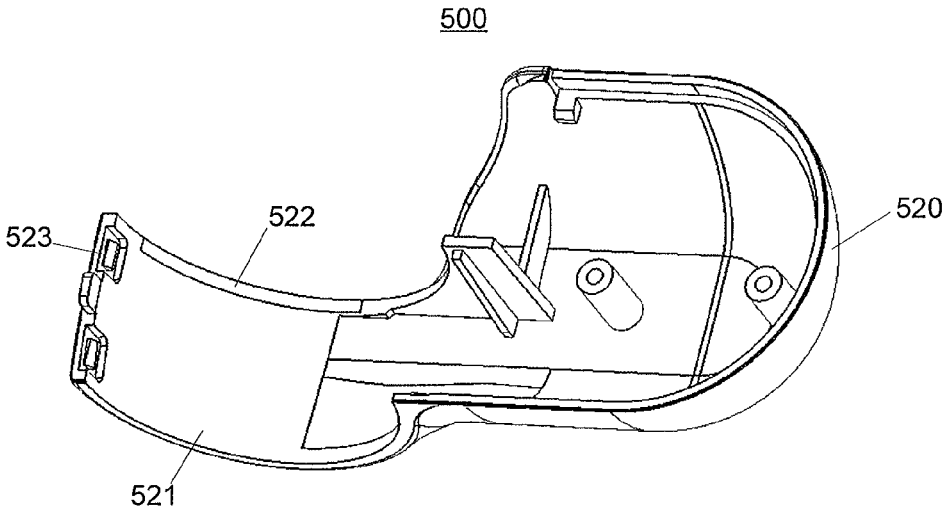
FIG. 3E is a bottom perspective view of a bottom housing of the outer segment shown in FIG. 3A.
Figure 3F:
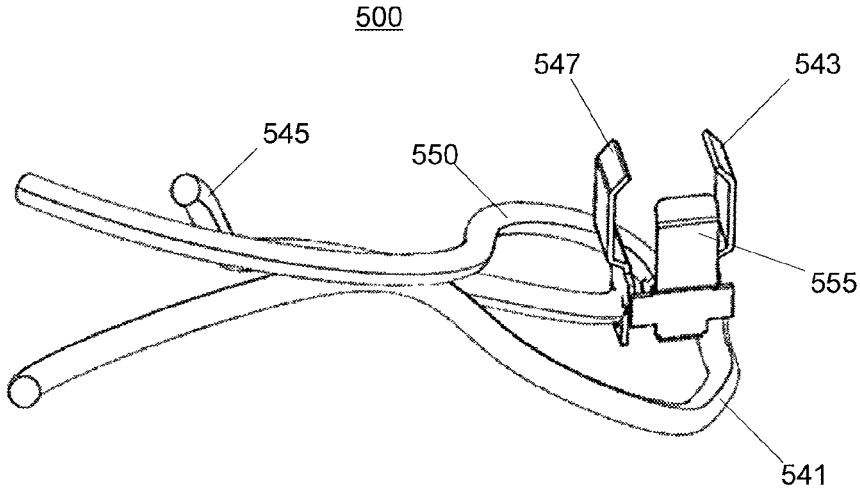
FIG. 3F is a view of an electrical portion of the outer segment shown in FIG. 3A.

FIGS. 3A-3F depicts elements of outer segment 500. Specifically, FIG. 3A is a perspective view of outer segment 500, FIG. 3B is a partially exploded view of outer segment 500, FIG. 3C is a top perspective view of a top housing 510 of outer segment 500, FIG. 3D is a bottom perspective view of top housing 510, FIG. 3E is a perspective view of a bottom housing 520 of outer segment 500, and FIG. 3F is a view of an electrical portion 502 of outer segment 500.

Outer segment 500 includes a mechanical portion 501 configured to movably connect outer segment 500 with a base segment, and/or outer segment 500'. Specifically, outer segment 500 is rotatable about a longitudinal axis of base segment 600. Mechanical portion 501 is configured to guide a device plug of a device into an outlet assembly 503 of outer segment 500. Mechanical portion 501 is also configured to mechanically connect the device plug to outer segment 500 via plug face 515 of outlet assembly 503. Mechanical portion 501 includes top housing 510 and bottom housing 520.

Top housing 510 and bottom housing 520 of mechanical portion 501 are configured to combine to substantially enclose electrical portion 502. Top housing 510 includes an arcuate portion 511 configured to couple outer segment 500 with base segment 600 and outer segment 500'. In this manner, outer segment 500 can be moved relative to outer segment 500' and base segment 600. Arcuate portion 511 includes a rotation track 512 and a rotation boss 513. Rotation boss 513 is configured to be disposed in a rotation track of a bottom housing of outer segment 500'. Rotation track 512 is configured to receive a rotation boss of the base segment 600. Rotation track 512 and rotation boss 513 of top housing 510 can combine with the rotation track of outer segment 500', and with the rotation boss of base segment 600, to define the range of relative rotational motion between outer segment 500, outer segment 500', and base segment 600. Top housing 510 can include at least one clip 519 configured to secure top housing 510 to bottom housing 520.

Top housing 510 includes a plug face 515. Plug face 515 includes a live receptacle 516, a neutral receptacle 517, and a ground receptacle 518. Each receptacle of outlet assembly 503 can be configured to direct and/or secure an associated mechanical portion of a device plug of an external device to and/or within outer segment 500. Each of live receptacle 516, neutral receptacle 517, and ground receptacle 518 includes a contact guide extending into outer segment 500, and configured to at least partially surround at least a portion of a live plug contact 543, a neutral plug contact 547, and a ground plug contact 555, respectively. In this manner, the receptacle can define the movement of the associated plug contact, as described herein. Top housing 510 includes live contact guide 526, neutral contact guide 527, and ground contact guide 528.

Bottom housing 520 includes an arcuate portion 521 configured to couple outer segment 500 with base segment 600 and outer segment 500'. In this manner, outer segment 500 can be moved relative to outer segment 500' and base segment 600. Arcuate portion 521 includes a rotation track 522. Rotation track 522 can be configured to receive a rotation boss of the outer segment 500'. Rotation track 522 of bottom housing 520 can combine with the rotation boss of outer segment 500', and with the rotation boss of base segment 600, to define the range of relative rotational motion between the outer segment 500, outer segment 500', and base segment 600. Bottom housing 520 can include at least one clip 523 configured to secure top housing 510 to bottom housing 520.

FIG. 3F is a view of electrical portion 502 of outer segment 500. Electrical portion 502 is configured to define a conductive, or power, path between outer segment 500 and a power source (not shown). Specifically, electrical portion 502 is configured to define the power path between outlet assembly 503 of outer segment 500 with the signal port, and/or an outlet assembly of base segment 600.

Electrical portion 502 is substantially disposed within mechanical portion 501. A portion of electrical portion 502 is exposed through, or partially disposed within, mechanical portion 501' of outer segment 500' and/or base segment 600. In this manner, electrical portion 502 of outer segment 500 can interconnect with an electrical portion of outer segment 500' and/or base segment 600. Electrical portion 502 can combine with the electrical portions of outer segment 500' and/or base segment 600 of plug adapter 400. Electrical portion 502 includes a live connector 541 configured to interconnect a live signal from a signal port, a neutral connector 545 configured to interconnect a neutral signal from the signal port, and a ground connector 550 configured to interconnect a ground signal from the signal port.

Each of live connector 541, neutral connector 545, and ground connector 550, collectively "the connectors," are configured to define a portion of a power path between the power source, outer segment 500', base segment 600, and/or a device plug. The connectors include a plug contact configured to operatively couple with an electrical portion of a device plug of a device external to the plug adapter 400, and to receive a signal from and/or send a signal to, the device. In some embodiments, the plug contact can be configured to impart a mechanical force on the device plug to hold the device plug in place within outlet assembly 503. A portion of the plug contact is disposed within a receptacle of plug face 515. As discussed above, the guide of a receptacle can define the motion of the plug contact. Live connector 541 includes a live plug contact 543; neutral connector 545 includes a neutral plug contact 547, and ground connector 550 includes a ground plug contact 555.

Returning to FIG. 3B, outlet assembly 503 includes elements and/or portions of elements of mechanical portion 501 and electrical portion 502. Outlet assembly 503 includes plug face 515, including live receptacle 516, neutral receptacle 517, and ground receptacle 518; and live plug contact 543, neutral plug contact 547, and ground plug contact 555. Outlet assembly 503 can be configured to mechanically direct and/or secure a mechanical portion of a device plug of an external device to and/or within outer segment 500, and can be configured to electrically direct and/or secure an electrical portion of a device plug of an external device to and/or within outer segment 500.

Figure 4A:
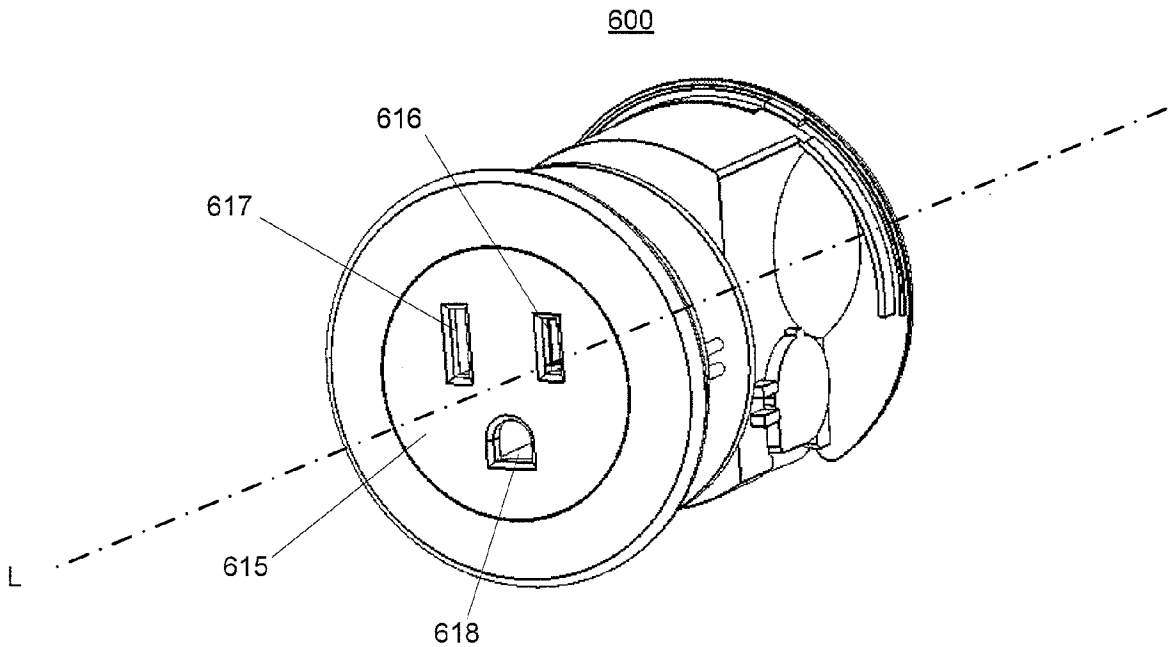
FIG. 4A is a perspective view of a base segment of the plug adapter shown in FIG. 2A.
Figure 4B:
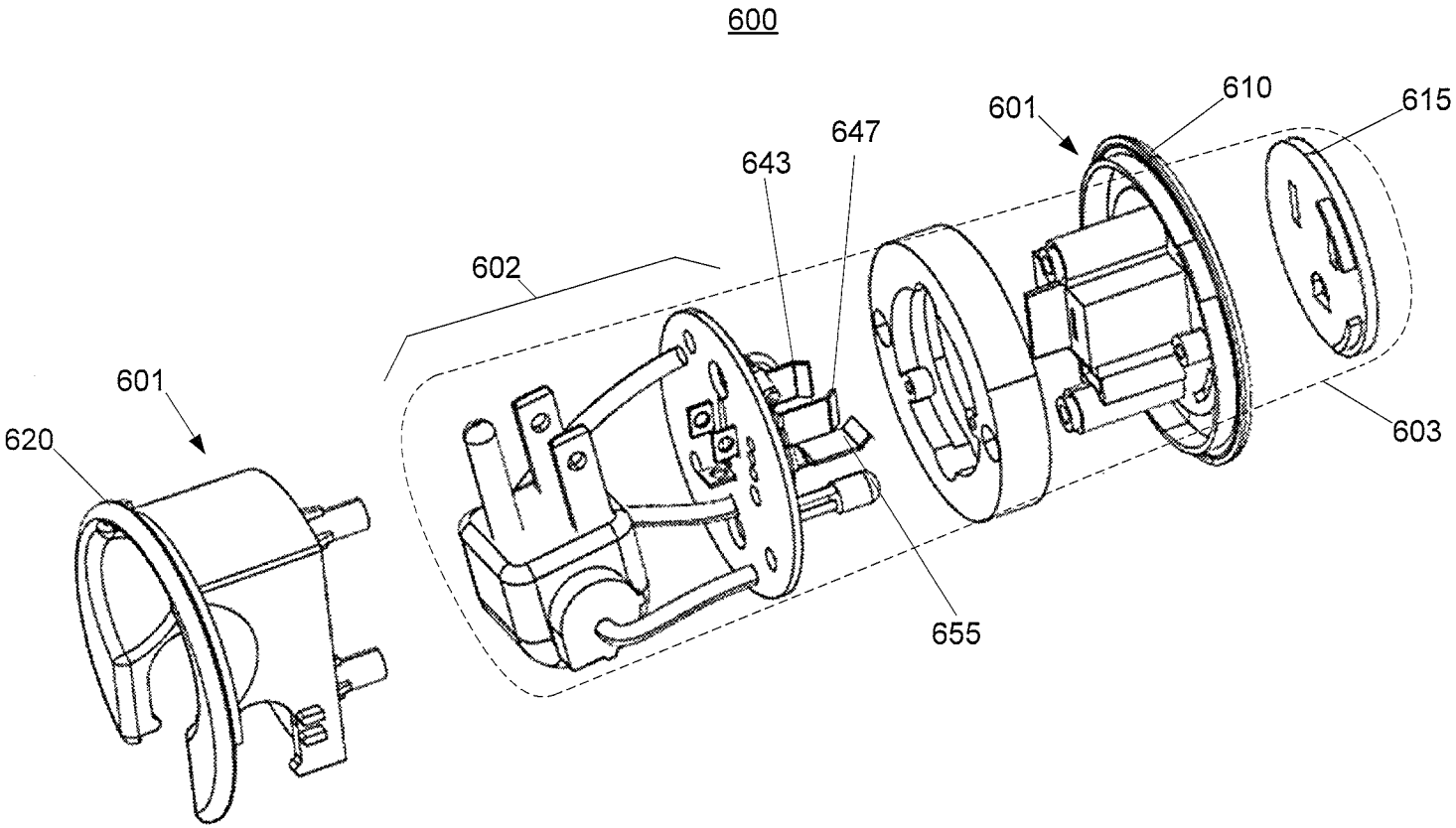
FIG. 4B is partially exploded view if the base segment show FIG. 4A.
Figure 4C:
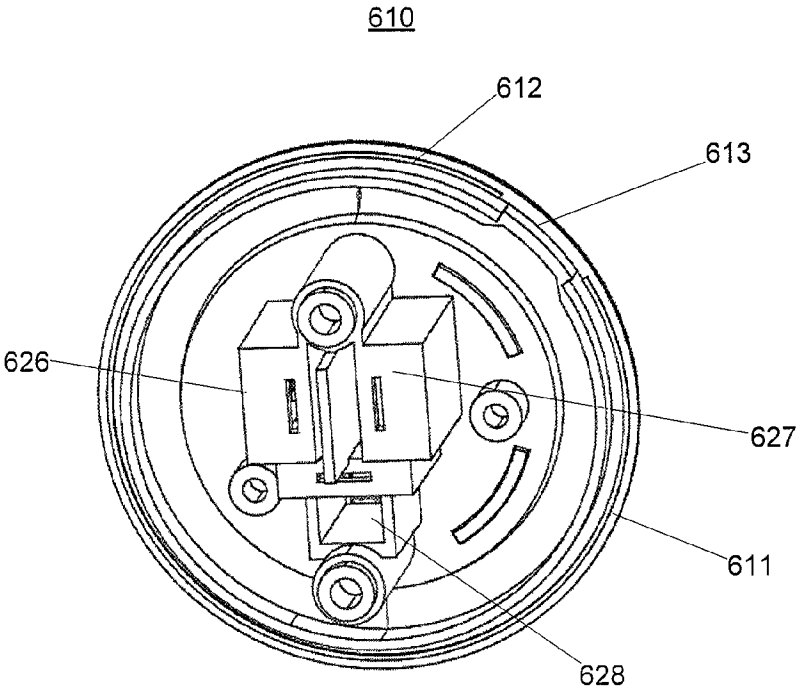
FIG. 4C is a back perspective view of a front housing of the base segment shown in FIG. 4A.
Figure 4E:
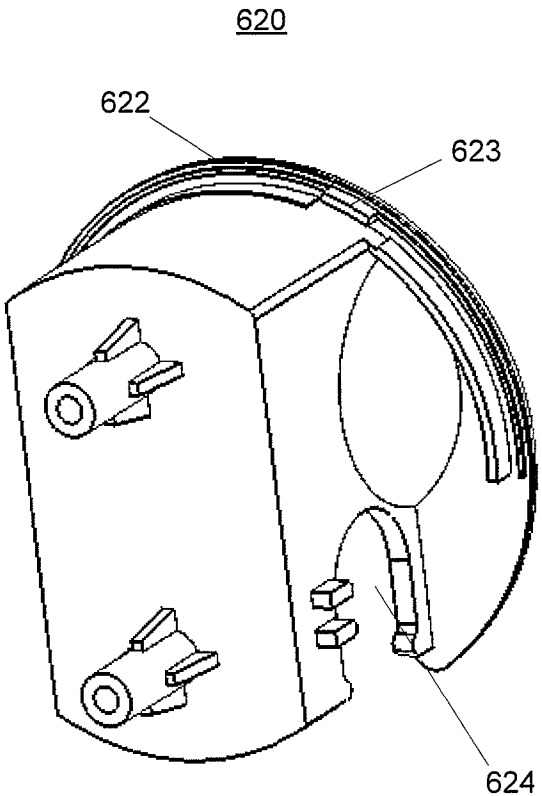
FIG. 4E is a front perspective view of the back housing shown in FIG. 4D.
Figure 4D:
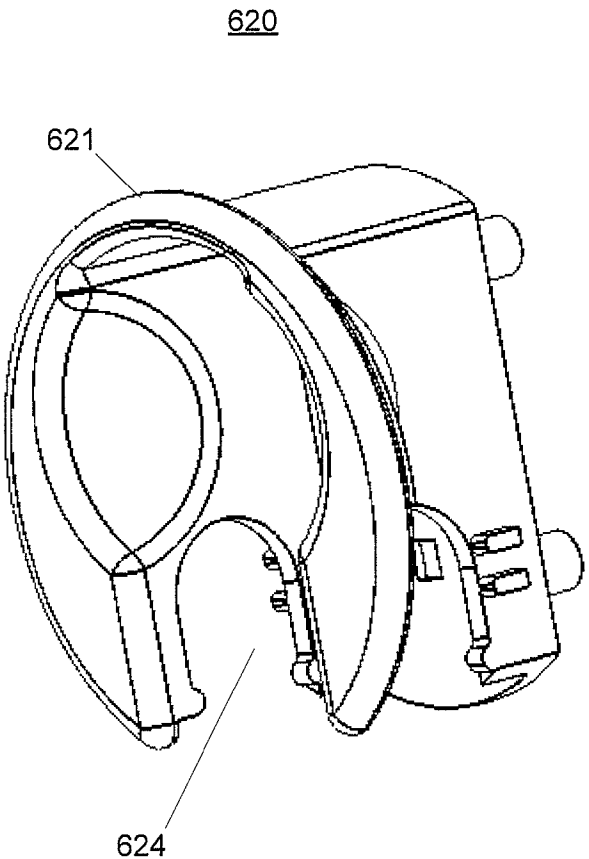
FIG. 4D is a back perspective view of a back housing of the base segment shown in FIG. 4A.
Figure 4F:
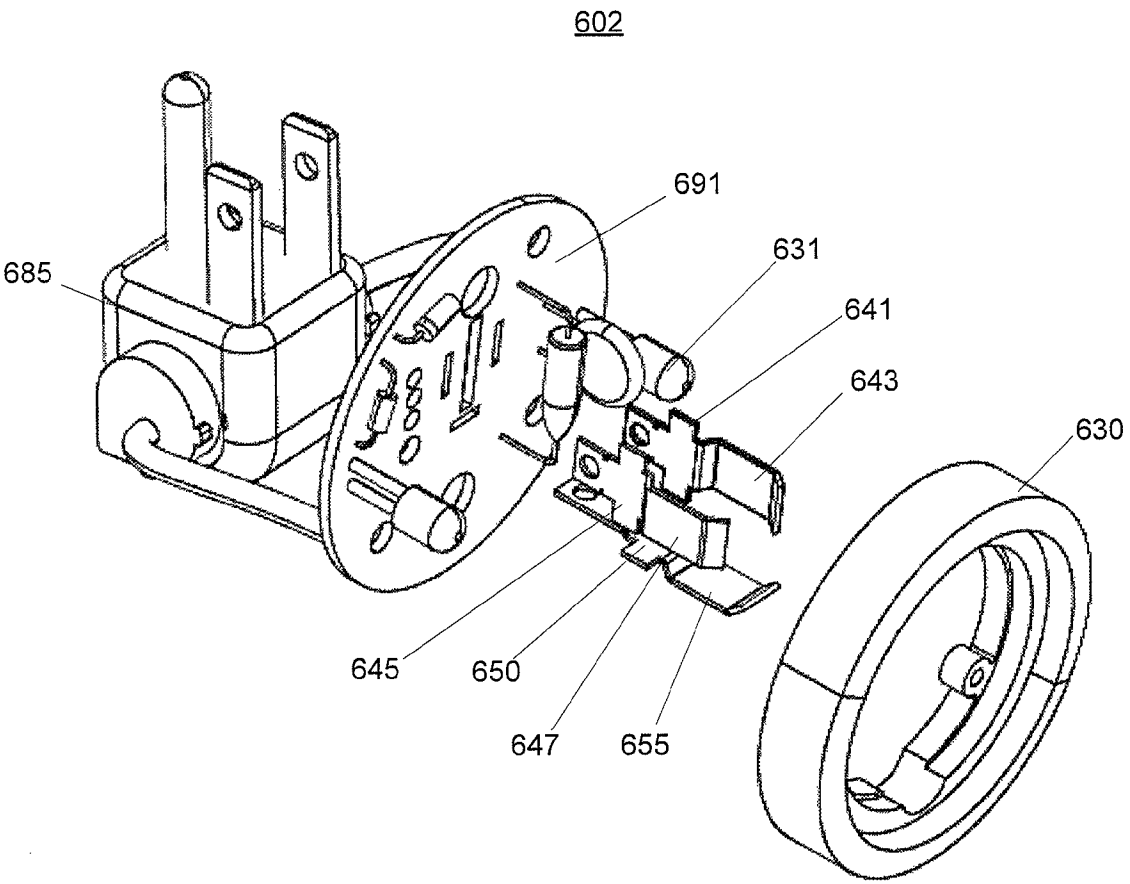
FIG. 4F is a view of an electrical portion of the base segment shown in FIG. 4A.

FIGS. 4A-4E depicts elements of base segment 600. Specifically, FIG. 4A is a perspective view of base segment 600, FIG. 4B is a partially exploded view of base segment 600, FIG. 4C is a perspective view of a front housing 610 of base segment 600, FIG. 4D is a back perspective view of a back housing 620 of base segment 600, FIG. 4E is a front perspective view of back housing 620, and FIG. 4F is a view of an electrical portion 602 of base segment 600.

Base segment 600 includes a mechanical portion 601 configured to movably connect base segment 600 with a outer segment 500, and/or outer segment 500'. Specifically, outer segment 500 and outer segment 500' are pivotable about a longitudinal axis L of base segment 600 (see, e.g., FIG. 4A). Mechanical portion 601 is configured to guide a device plug (not shown) of a device (not shown) into an outlet assembly 603 of base segment 600. Mechanical portion 601 is also configured to mechanically connect the device plug to base segment 600 via plug face 615 of outlet assembly 603. Mechanical portion 601 includes front housing 610 and rear housing 620.

Front housing 610 and rear housing 620 of mechanical portion 601 are configured to combine to enclose a portion of electrical portion 602. Front housing 610 includes an arcuate portion 611 configured to couple outer segment 500 with base segment 600 and outer segment 500'. In this manner, outer segment 500 can be moved relative to outer segment 500' and base segment 600. Arcuate portion 611 includes a rotation track 612 and a rotation boss 613. Rotation boss 613 can be configured to be disposed in rotation track 512 of a top housing 510 of outer segment 500. Rotation track 612 can be configured to receive a rotation boss of the outer segment 500. Rotation track 612 and rotation boss 613 of front housing 610 can combine with the rotation track and the rotation boss of outer segment 500, to define the range of relative rotational motion between the outer segment 500, outer segment 500', and base segment 600.

Front housing 610 includes a plug face 615. Plug face 615 includes a live receptacle 616, a neutral receptacle 617, and a ground receptacle 618. Each receptacle of outlet assembly 603 can be configured to direct and/or secure an associated mechanical portion of a device plug of an external device to and/or within base segment 600. Each of live receptacle 616, neutral receptacle 617, and ground receptacle 618 includes a contact guide extending into base segment 600, and configured to at least partially surround at least a portion of a live plug contact 643, a neutral plug contact 647, and a ground plug contact 655, respectively. In this manner, the receptacle can define the movement of the associated plug contact, as described herein. Front housing 610 includes live contact guide 626, neutral contact guide 627, and ground contact guide 628.

Back housing 620 includes an arcuate portion 621 configured to couple outer segment 500 with base segment 600 and outer segment 500'. In this manner, outer segment 500 can be moved relative to outer segment 501' and base segment 600. Arcuate portion 621 includes a rotation track 622 and a rotation boss 623. Rotation track 622 can be configured to receive a rotation boss of the outer segment 500'. Rotation track 622 of back housing 620 can combine with the rotation boss of outer segment 500', to define the range of relative rotational motion between the outer segment 500, outer segment 500', and base segment 600. Back housing 620 include at least one aperture 624 configured to receive plug 685. Aperture 624 allows the rotational movement of plug 685.

FIG. 4F is a fully exploded view of electrical portion 602 of base segment 600. Electrical portion 602 is configured to define a conductive, or power, path between base segment 600 and a power source (not shown). Specifically, electrical portion 602 is configured to define the power path between outlet assembly 603 of base segment 600 with the signal port.

Electrical portion 602 is substantially disposed within mechanical portion 501 of outer segment 500 and mechanical portion 501' of outer segment 500', and substantially disposed between front housing 610 and back housing 620 of base segment 600. Electrical portion 602 of base segment 600 can interconnect with an electrical portion of outer segment 500' and/or outer segment 500. Electrical portion 602 can combine with the electrical portions of outer segment 500' and/or outer segment 500 of plug adapter 400. Electrical portion 602 includes a live connector 641 configured to interconnect a live signal from a signal port, a neutral connector 645 configured to interconnect a neutral signal from the signal port, a ground connector 651 configured to interconnect a ground signal from the signal port, a printed circuit board 691, a live plug contact 643, a neutral plug contact 647, and a ground plug contact 655. Live plug contact 643, neutral plug contact 647, and ground plug contact 653, can be similar to live plug contact 543, neutral plug contact 547, and ground plug contact 555 described above.

Each of live connector 641, neutral connector 645, and ground connector 651, collectively "the connectors," are configured to define a portion of a power path between the power source, outer segment 500', base segment 600, and/or an a device plug. Specifically, the connectors coupled plug 685 to printed circuit board 691, and to the electrical portions of outer segment 500 and outer segment 500'.

Printed circuit board 691 is configured to selectively interconnect electrical portion 602, electrical portion 502, and electrical portion 502', with the plug 685. Printed circuit board 691 can also provide surge protection to plug adapter 400. In such embodiments, printed circuit board 691 can include varistors, such as, for example, metal oxide varistors to provide the surge protection. Plug 685 includes a live prong, a neutral prong, and a ground prong, and is rotatable into and out of plug adapter 685 (see, e.g., FIG. 2B and FIG. 4F, respectively). Printed circuit board 691 can also includes at least one light source 631, for example, an LED configured to illuminate a light ring 630 of base segment 600.

Returning to FIG. 4B, outlet assembly 603 includes element and/or portions of elements of mechanical portion 601 and electrical portion 602. Outlet assembly 603 includes plug face 615, including live receptacle 616 (see, e.g., FIG. 4A), neutral receptacle 617 (see, e.g., FIG. 4A), and ground receptacle 618 (see, e.g., FIG. 4A); and live plug contact 643, neutral plug contact 647, and ground plug contact 655. Outlet assembly 603 can be configured to mechanically direct and/or secure a mechanical portion of a device plug of an external device to and/or within base segment 600, and can be configured to electrically direct and/or secure an electrical portion of a device plug of an external device to and/or within base segment 600.

Figure 5:
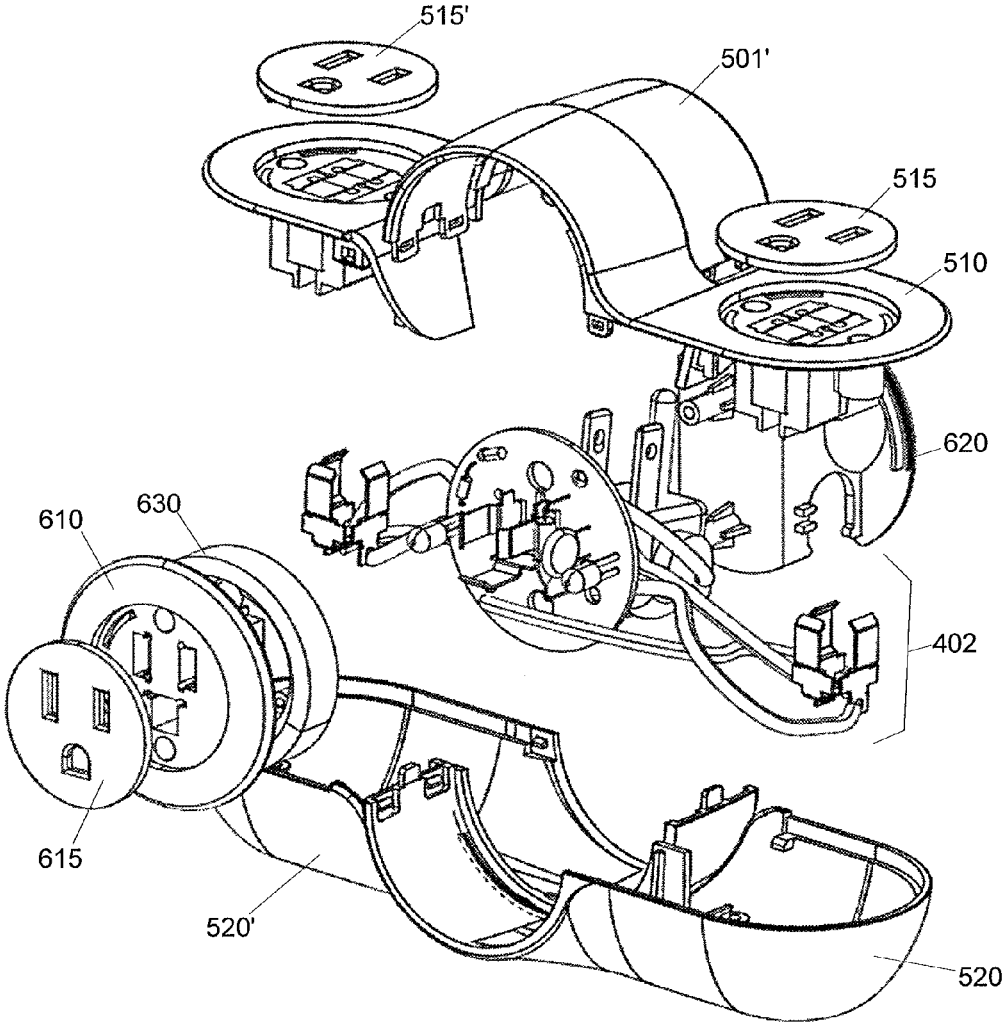
FIG. 5 is a partially exploded view of the plug adapter shown in FIG. 2A.

FIG. 5 is a partially exploded view of plug adapter 400. Plug adapter 400 includes electrical portion 402. Electrical portion 402 includes electrical portion 502 of outer segment 500, electrical portion 502' of outer segment 500' and electrical portion 602 of base segment 600. Electrical portion 402 is configured to define a conductive, or power, path between outer segment 500, outer segment 500', base segment 600, and a power source (not shown). Specifically, electrical portion 402 is configured to define the power path between outlet assembly 503 of outer segment 500, and outlet assembly of outer segment 500', and outlet assembly 603 of base segment 600, with the signal port, and/or an outlet assembly of base segment 600. As shown in FIG. 5, outer segment 500' can be similar to outer segment 500. By way of example, outer segment 500' can include a top housing 510' similar to top housing 510 of outer segment 500. Unlike outer segment 500, the locations and orientations of certain elements can be different in order to coupled outer segment 500, outer segment 500', and base segment 600. By way of example, the locations and orientations of rotation bosses and rotation tracks of outer segment 500' can be different.

Figure 6B:
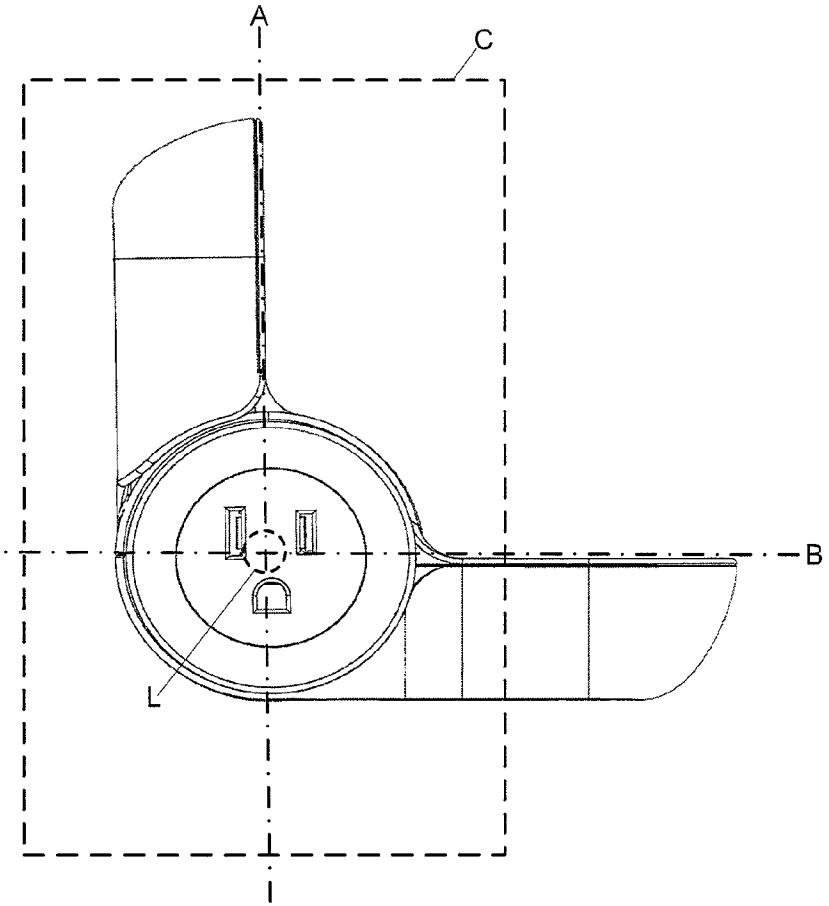
FIG. 6B is a front view of the plug adapter shown in FIG. 6A in the second configuration.
Figure 6A:
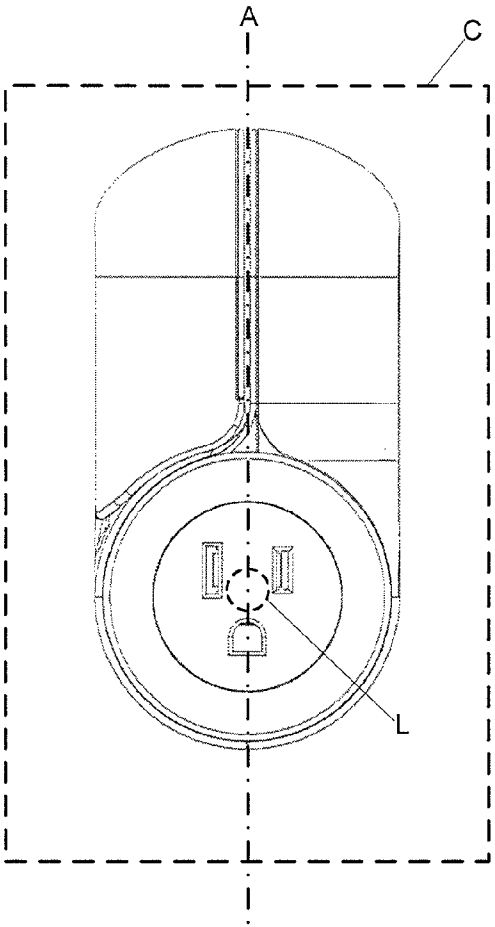
FIG. 6A is a front view of the plug adapter in the first configuration according to an embodiment.
Figure 6D:
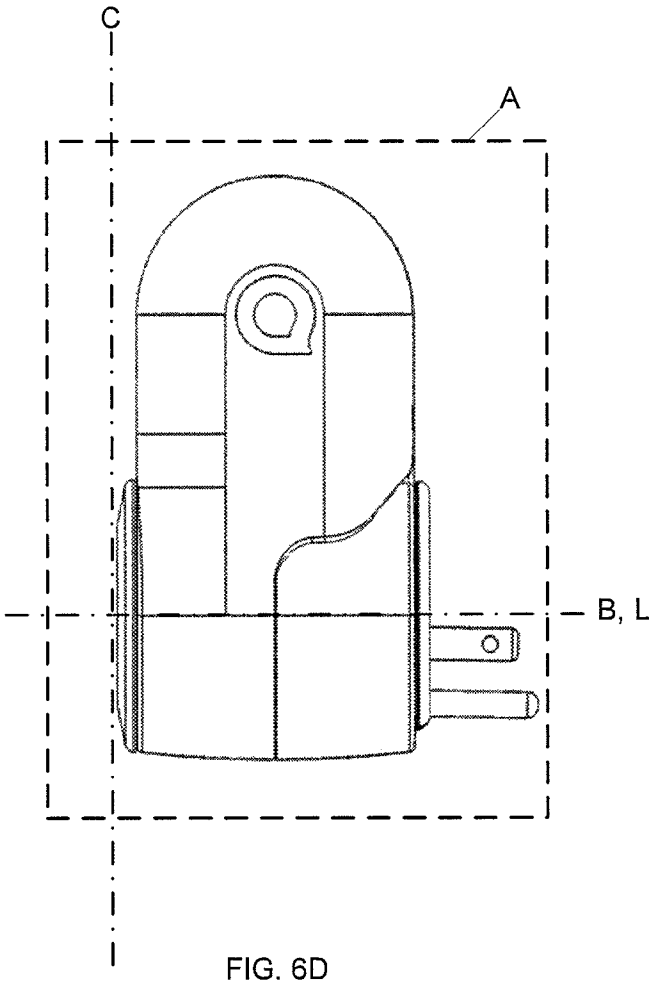
FIG. 6D is a right side view of the plug adapter shown in FIG. 6A in the first configuration.
Figure 6C:
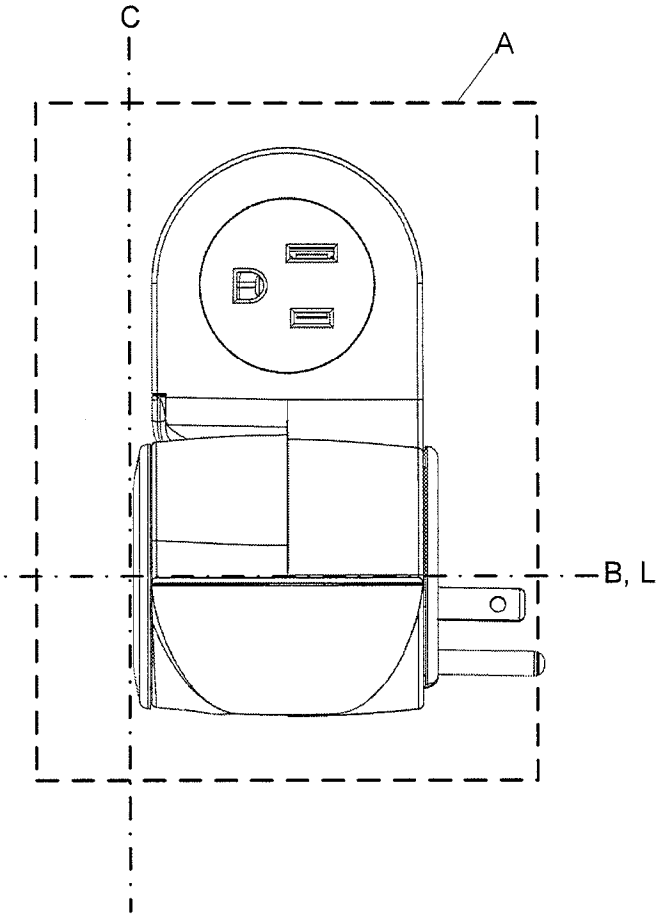
FIG. 6C is a right side view of the plug adapter shown in FIG. 6A in the second configuration.

FIG. 6A is a front view of plug adapter 400 in the first configuration, FIG. 6B is a front view of plug adapter 400 in the second configuration, FIG. 6C is a right side view of plug adapter 400 in the second configuration, and FIG. 6D is a right side view of plug adapter 400 in the first configuration. As shown in FIGS. 6A-6D, and as described above, plug adapter 400 includes a base segment 600 having a plug face 615, an outer segment 500 including a plug face 515, and an outer segment 500' including a plug face 515'. Outer segment 500 and outer segment 501 can move relative to each other and base segment 600 about longitudinal axis L of base segment 600, and with respect to planes A, B, and C.

Outer segment 500 and outer segment 500' are rotatable relative to each other about axis L from the first configuration, (e.g. when plug face 515 is substantially disposed in plane A and when plug face 515' is also substantially disposed within plane A, FIG. 6A), to the second configuration, (e.g. when plug face 515 is substantially disposed in plane A and when plug face 515' is substantially disposed within plane B, FIG. 6B), and to the third configuration (e.g. when plug face 515 is substantially disposed in plane B and when plug face 515' is also substantially disposed within plane B, (not shown)). The maximum rotation is defined or limited by the rotation tracks and rotation bosses of outer segment 500, outer segment 500', and base segment 600. As outer segment 500 is moved relative to outer segment 500', plug face 615 substantially stays in plane C. As shown in FIG. 6A, when plug adapter 400 is in the first configuration, plug face 515 is parallel to plug face 515' within plane A, and both plug face 515 and plug face 515' are perpendicular to plug face 615 disposed within plane C. As shown in FIG. 6C, when plug adapter 400 is in the second configuration, plug face 515 is disposed within plane A and is perpendicular to plug face 515' disposed within plane B, and both plug face 515 and plug face 515' are separately perpendicular to plug face 615 disposed within plane C.

Figure 7A:
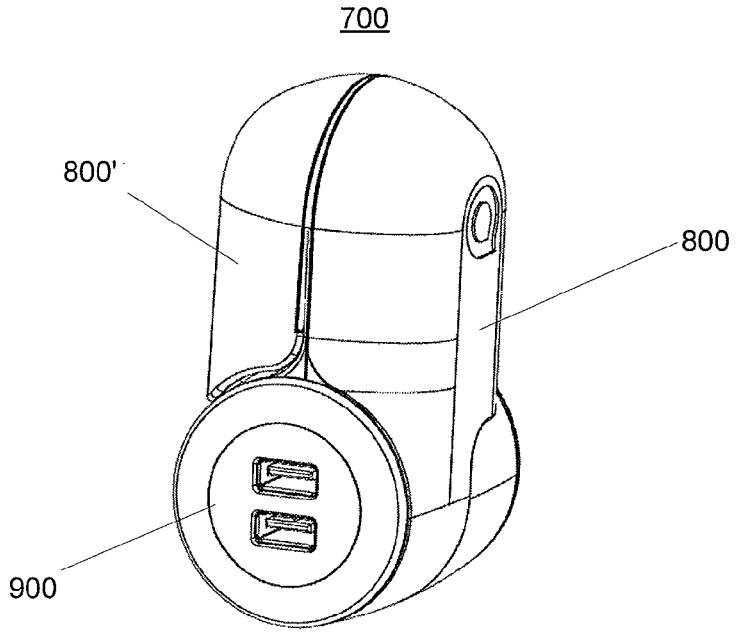
FIG. 7A is a front perspective view of a plug adapter in a first configuration according to an embodiment.
Figure 7B:
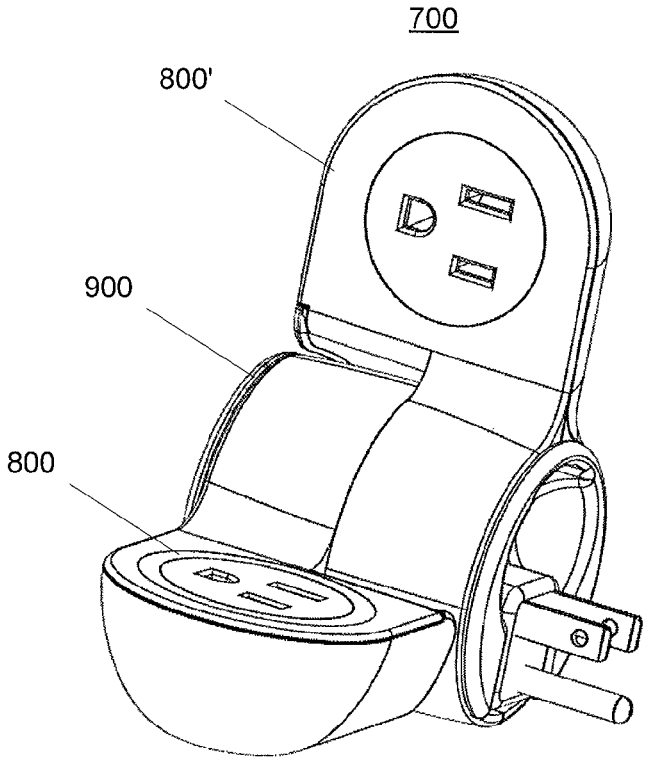
FIG. 7B is a rear perspective view of the plug adapter shown in FIG. 7A in a second configuration.
Figure 7C:
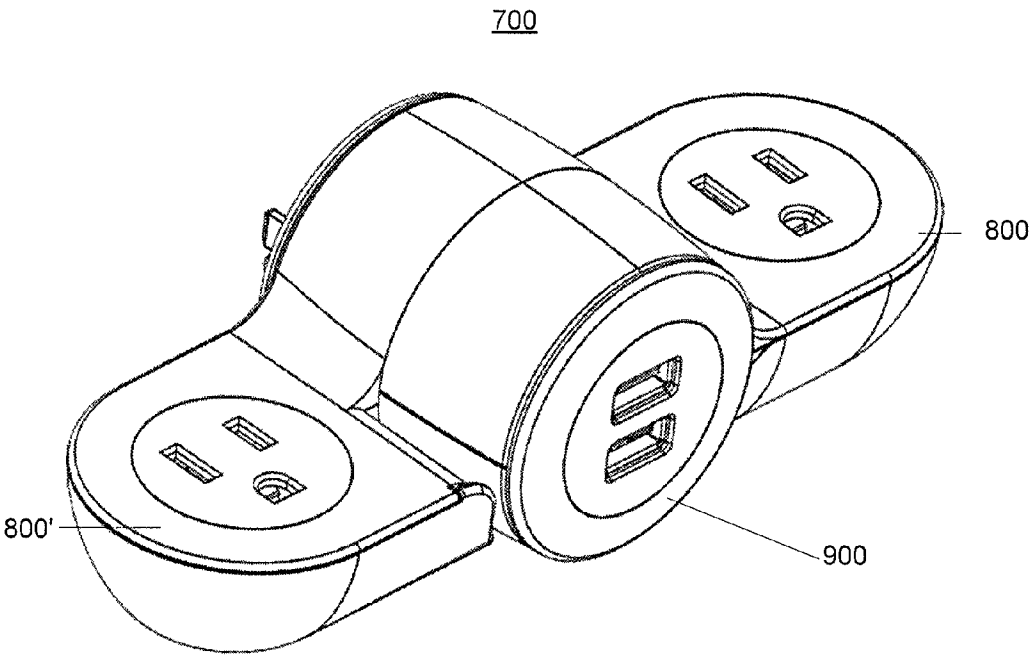
FIG. 7C is a front perspective view of the plug adapter shown in FIG. 7A in a third configuration.

An alternative implementation of a plug adapter is described in detail below. This implementation is an electrical power adapter, specifically, a 120 volt, 3 prong plug adapter and a data adapter, specifically, a universal serial bus (USB) adapter. FIGS. 7A-7C depict a plug adapter 700. Specifically, FIG. 7A is a front perspective view of plug adapter 700 in a first configuration (closed), FIG. 7B is a rear perspective view of plug adapter 700 in a second configuration (partially open), FIG. 7C is a front perspective view of plug adapter 700 in a third configuration (fully open). Plug adapter 700 includes a base segment 900 an outer segment 800 and an outer segment 800'. As shown in FIGS. 7A-7C, base segment 900 includes two USB receptacles, outer segment 800 includes a single 3 prong plug receptacle, and outer segment 800' includes a single 3 prong plug receptacle.

Figure 8:
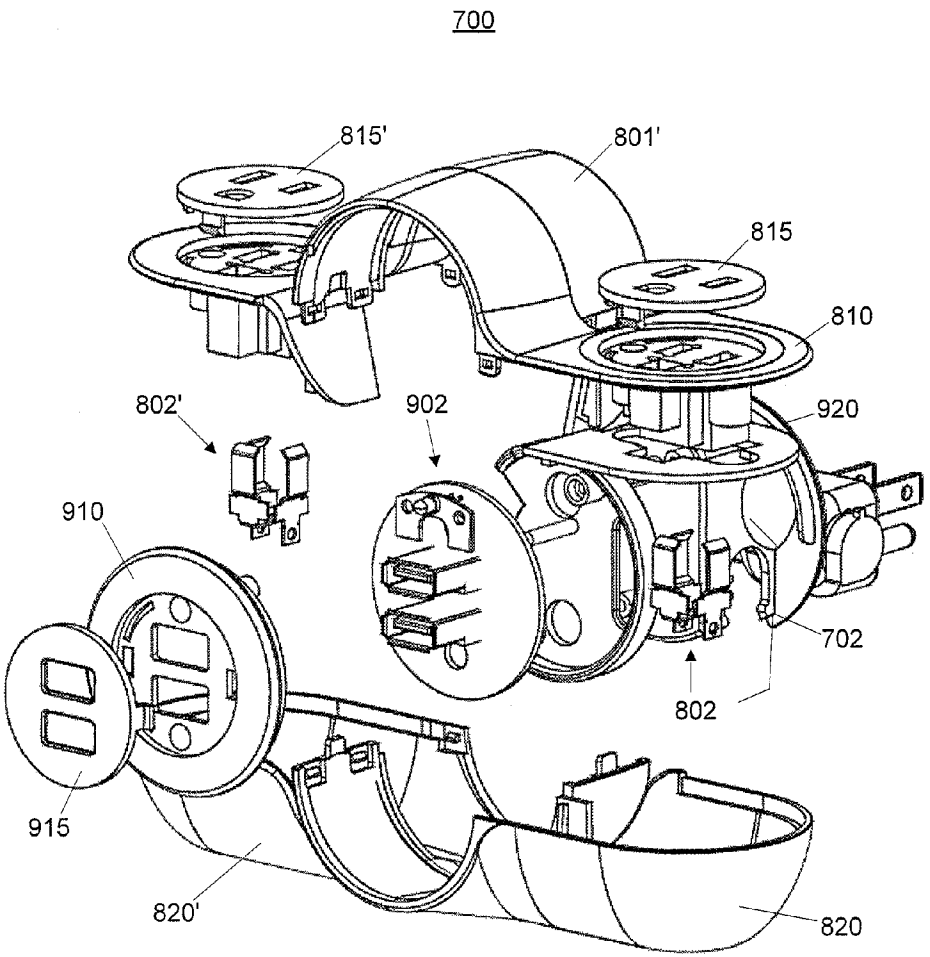
FIG. 8 is a partially exploded view of the plug adapter shown in FIG. 7A.

FIG. 8 is a partially exploded view of plug adapter 700. Plug adapter 700 includes electrical portion 702. Electrical portion 702 includes electrical portion 802 of outer segment 800, electrical portion 802' of outer segment 800' and electrical portion 902 of base segment 900. Electrical portion 702 is configured to define a conductive, or power, path between outer segment 800, outer segment 800', base segment 900, and a power source (not shown). Specifically, electrical portion 702 is configured to define the power path between outlet assembly 803 of outer segment 800, an outlet assembly of outer segment 800', and outlet assembly 903 of base segment 900, with the signal port, and/or an outlet assembly of base segment 900. Electrical portion 702 can be similar to electrical portion 402, but can include different connection, for example, wiring (not shown) and/or other components to convert power from a 3 prong 120 volt signal port to power to a USB receptacle, including, but not limited to, voltage and/or current changes. As shown in FIG. 8, outer segment 800 and outer segment 800' can be similar to outer segment 500. By way of example, outer segment 800 can include a top housing 810' similar to top housing 510 of outer segment 500. Similar to outer segment 500 and outer segment 500', the locations and orientations of certain elements of outer segment 800' can be different than outer segment 800 in order to couple outer segment 800, outer segment 800', and base segment 900. By way of example, the locations and orientations of rotation bosses and rotation tracks of outer segment 800' can be similar to outer segment 500' but different than outer segment 800. As shown in FIG. 8, base segment 900 can be similar to base segment 600. Unlike base segment 600, base segment 900 can include USB receptacles configured to define a power path from, for example, a 3 prong 120 volt signal source, to each of the USB receptacles.

Each of the components of the plug adapters discussed herein can be monolithic or a combination of parts. By way of example, with reference to FIG. 3C, rotation boss 512 and arcuate portion 511 of top housing 510 can be a single piece. In other embodiments, rotation boss 512 can be separate from arcuate portion 511 and can be permanently or temporarily fixed to top housing 510. Similarly, and with reference to FIG. 3F, live connector 541 can be formed from a single piece of metal. In other embodiments, live plug contact 543 can be separate from live connector 541 and be permanently or temporarily fixed to live connector 541. Each of the components of the plug adapters described herein can be cast (molded) into a final shape or configuration, may be manipulated (stamped and/or bent) into the final shape or configuration, and/or may be cast and manipulated into the final shape or configuration. Conducting components, such as live connector 541 can include any known conducting material, such as a metal or metal alloy, and non-conducting, insulating, and/or support members can include any know insulating material, such as a plastic, polymer, etc. In some embodiments, a top (or front) or bottom (or back) housing can function as a rotation boss, without a defined rotation boss. By way of example, bottom housing 520 of outer segment 500 can be disposed into rotation track 612 of front housing 610 of base segment 600.

While various embodiments have been described above, it should be understood that they have been presented by way of example only, not limitation, and various changes in form and details may be made. While the plug adapters are shown and described as having a certain number of segments, in some embodiments, more or fewer segments can be included. While the plug adapters are shown and/or described as having certain configurations (i.e. closed, partially open, and fully open), in some embodiments, the plug adapters can have virtually any configuration based, at least, on the number of segments and/or characteristics of the segments. While the segments are shown and/or described as rotating about a single axis, in some embodiments, the segments can move relative to one another in more than one plane and/or axis, such as, for example, twisting about an axis perpendicular to a plug face, bending about an axis perpendicular to a plug face, translating along an axis, and/or combinations of such relative movements.

While shown and/described as a 120V three prong plug, any of the plug adapters described herein can be configured for other power sources, audio, video and/or data sources, or combinations of sources, such as, for example, universal serial bus (USB), Fire Wire, international power standards, etc. In such embodiments, the plug adapter and associated segments can have more or fewer signal paths, and more or fewer associated components in accordance with the signal requirements, such as, for example, connectors, tracks, insulation members, support members, etc. Furthermore, the components shapes and characteristics of the components can be modified based on the type of outlet/plug and the number of associated components. In some embodiments, a first segment can include a first plug type and a second segment can include a second plug type. By way of example, a base segment can include one or more universal serial bus ports, and an outer segment can include a 120V three prong plug.

Other aspects of the plug adapters shown and described can be modified to affect the performance and/or characteristics of the plug adapter. By way of example, in some embodiments, the range of relative motion can be defined by the size and/or shape of the rotation track, the size, shape, and/or number of rotation bosses, and/or the type of plug/outlet. Similarly, light ring 630 can be a uniform light source, non-uniform light source, can indicate on and/or off, etc. In some embodiments, a plug adapter can include a point light instead of, or in addition to, the light ring. By way of example, front housing 610 of base segment 600 can include an aperture configured to allow light from light source 631 to be visible through front housing 610. In such embodiments, the aperture can be fully or partially covered by a translucent, semi-translucent, and/or colored window. The color of the light visible through light ring 630 and/or the aperture can be based on light source 631, a color of a window covering the aperture and/or a color of light ring 630, and/or by a combination of the color of light source 631, the color of the window, and/or the color of light ring 630. The plug adapters can also include device protections, such as, for example, fuses, breakers, surge protection elements, etc.

Any portion of the apparatus and/or methods described herein may be combined in any combination, except mutually exclusive combinations. The embodiments described herein can include various combinations and/or sub-combinations of the functions, components and/or features of the different embodiments described.

The invention claimed is:

1. An apparatus for providing an electrical signal path between an electrically conductive portion of a device plug and a signal port, the apparatus comprising:

a first housing segment having a longitudinal axis, said first housing segment including:

a first receptacle configured to receive at least the electrically conductive portion of the device plug; and a signal port coupler configured to selectively conductively engage with the signal port;

a second housing segment having a second receptacle configured to receive at least the electrically conductive portion of the device plug, said second housing segment coupled to said first housing segment for movement relative to said first housing segment about the longitudinal axis of said first housing segment; and a third housing segment having a third receptacle configured to receive at least the electrically conductive portion of the device plug, said third housing segment coupled to said first housing segment for movement relative to said first housing segment about the longitudinal axis of said first housing segment.

2. The apparatus of claim 1, wherein the signal port coupler is pivotally coupled to the first housing segment.

3. The apparatus of claim 1, wherein the movement relative to said first housing segment about the longitudinal axis of said first housing segment is rotational.

4. The apparatus of claim 1, wherein (1) a first plug face of said second receptacle is disposed in a first plane when the apparatus is in a first orientation, (2) a second plug face of said third receptacle is disposed in the first plane when the apparatus is in the first orientation, (3) said first plug face of said second receptacle is disposed in the first plane when the apparatus is in a second orientation, and (4) said second plug face of said third receptacle is disposed in a second plane different from the first plane when the apparatus is in the second orientation.

5. The apparatus of claim 1, wherein said second housing segment is coupled to said first housing segment for movement relative to said first housing segment about the longitudinal axis of said first housing segment from a first orientation to a second orientation, wherein a plug face of the second receptacle is in a first plane in the first orientation and a second plane in the second orientation, the second plane different than the first plane.

6. The apparatus of claim 1, wherein the device plug is a power plug, the signal port is a power outlet, and the electrically conductive portion is a live conductive portion.

7. An apparatus for providing an electrical signal path between an electrically conductive portion of a device plug and a signal port, the apparatus comprising:

a first housing segment having a longitudinal axis, said first housing segment including:

a first receptacle configured to receive at least the electrically conductive portion of the device plug, said first receptacle including a first plug face disposed in a first plane; and a signal port coupler configured to selectively conductively engage with the signal port;

a second housing segment having a second receptacle configured to receive at least the electrically conductive portion of the device plug, said second housing segment coupled to said first housing segment for movement relative to said first housing segment about the longitudinal axis of said first housing segment between a first orientation and a second orientation, said second receptacle including a second plug face disposed in a second plane in the first orientation, the second plane different from the first plane; and a third housing segment having a third receptacle configured to receive at least the electrically conductive portion of the device plug, said third housing segment coupled to said first housing segment for movement relative to said first housing segment about the longitudinal axis of said first housing segment between the first orientation and the second orientation, said third receptacle including a third plug face disposed in the second plane in the first orientation.

8. The apparatus of claim 7, wherein the signal port coupler is pivotally coupled to the first housing segment.

9. The apparatus of claim 7, wherein the movement relative to said first housing segment about the longitudinal axis of said first housing segment is rotational.

10. The apparatus of claim 7, wherein said second plug face is disposed substantially parallel to said third plug face when in the first orientation, and where said second plug face is disposed substantially perpendicular to said third plug face when in the second orientation.

11. The apparatus of claim 7, wherein the second plane is perpendicular to the first plane.

12. An apparatus for providing an electrical signal path between an electrically conductive portion of a first device plug and a signal port and between an electrically conductive portion of a second device plug and the signal port, the apparatus comprising:

a first housing segment including:

a first receptacle configured to receive at least the electrically conductive portion of the first device plug, said first receptacle including a first plug face, said first plug face oriented in a first plane; and a signal port coupler configured to selectively conductively engage with the signal port, said signal port coupler configured to be disposed substantially within said first housing segment in a first position, and a portion of said signal port coupler is configured to be disposed outside of said first housing segment in a second position; and a second housing segment having a second receptacle configured to receive at least the electrically conductive portion of the second device plug, said second receptacle including a second plug face disposed in a second plane different from the first plane, said second plug face configured to move from a first orientation to a second orientation, said second plug face disposed in a third plane in the second orientation, the third plane different from the first plane and the second plane.

13. The apparatus of claim 12, wherein the first device plug is a power plug, the signal port is a power outlet, and the electrically conductive portion is a live conductive portion.

14. The apparatus of claim 12, wherein (1) the third plane is perpendicular to the first plane, (2) the third plane is perpendicular to the second plane, and (3) the second plane and the third plane are perpendicular to the first plane.

15. The apparatus of claim 12, further including a third housing segment having a third receptacle configured to receive at least the electrically conductive portion of the second device plug, said third receptacle including a third plug face, said third plug face disposed in the second plane.

16. The apparatus of claim 15, wherein said third housing segment is coupled to said first housing segment for movement relative to said first housing segment about a longitudinal axis of said first housing segment.

17. The apparatus of claim 15, wherein at least one of said second housing segment and said third housing segment include a top housing portion and a bottom housing portion.

18. The apparatus of claim 12, wherein the signal port coupler is a power plug.

19. The apparatus of claim 12, wherein said first receptacle is a data plug receptacle and said second receptacle is a power plug receptacle.

20. The apparatus of claim 12, further including a light source configured to illuminate when said signal port coupler is conductively engaged with the signal port.

21. The apparatus of claim 12, wherein said first receptacle is a plurality of data plug receptacles.

22. An apparatus for providing an electrical signal path between an electrically conductive portion of a first device plug and a signal port and between an electrically conductive portion of a second device plug and the signal port, the apparatus comprising:

a first housing segment including:

a first receptacle configured to receive at least the electrically conductive portion of the first device plug, said first receptacle including a first plug face, said first plug face oriented in a first plane; and a signal port coupler configured to selectively conductively engage with the signal port, said signal port coupler configured to be disposed substantially within said first housing segment in a first position, and a portion of said signal port coupler is configured to be disposed outside of said first housing segment in a second position;

a second housing segment having a second receptacle configured to receive at least the electrically conductive portion of the second device plug, said second receptacle including a second plug face, said second plug face disposed in a second plane, the second plane different from the first plane; and a third housing segment having a third receptacle configured to receive at least the electrically conductive portion of the second device plug, said third receptacle including a third plug face, said third plug face disposed in the second plane.

23. The apparatus of claim 22, wherein said third housing segment is coupled to said first housing segment for movement relative to said first housing segment about a longitudinal axis of said first housing segment.

24. The apparatus of claim 22, wherein at least one of said second housing segment and said third housing segment include a top housing portion and a bottom housing portion.

* * * * *